US006230518B1

(12) United States Patent
Hahn et al.

(10) Patent No.: US 6,230,518 B1
(45) Date of Patent: May 15, 2001

(54) PROCESS AND LIQUEFIER FOR THE PRODUCTION OF LIQUID AIR

(75) Inventors: Eric Hahn, Eurasburg; Jürgen Voit, Schondorf a.A., both of (DE)

(73) Assignee: Linde Aktiengesellschaft, Weisbaden (DE)

( * ) Notice: Subject to any disclaimer, the term of this patent is extended or adjusted under 35 U.S.C. 154(b) by 0 days.

(21) Appl. No.: 09/401,949

(22) Filed: Sep. 23, 1999

(30) Foreign Application Priority Data

Sep. 23, 1998 (DE) ..... 198 43 629

(51) Int. Cl.[7] ..... F25J 1/00
(52) U.S. Cl. ..... 62/615
(58) Field of Search ..... 62/615, 640, 646, 62/643, 908

(56) References Cited

U.S. PATENT DOCUMENTS

| | | | | |
|---|---|---|---|---|
| 4,169,361 | | 10/1979 | Baldus | 62/402 |
| 5,373,699 | | 12/1994 | Gastinne et al. | 62/24 |
| 5,379,598 | * | 1/1995 | Mostello | 62/24 |
| 5,454,226 | * | 10/1995 | Darredeau et al. | 62/9 |
| 5,454,227 | * | 10/1995 | Straub et al. | 62/25 |
| 5,507,147 | | 4/1996 | Förster | 62/11 |
| 5,546,765 | | 8/1996 | Nagamura et al. | 62/643 |

FOREIGN PATENT DOCUMENTS

| | | |
|---|---|---|
| 43 03 670 | 8/1994 | (DE) . |
| 0 774 634 | 5/1997 | (EP) . |
| 0 856 713 | 8/1998 | (EP) . |

* cited by examiner

*Primary Examiner*—William Doerrler
*Assistant Examiner*—Malik N. Drake
(74) *Attorney, Agent, or Firm*—Millen, White, Zelano & Branigan, P.C.

(57) ABSTRACT

The invention relates to a process and a liquefier for the production of liquid air with an oxygen content of between 16 and 21 mol % in a low-temperature process, whereby atmospheric air is used as a feed gas; in a warm part of the process, $H_2O$, carbon dioxide and contaminants entrained in the air are removed in a purification step, e.g. adsorption; cold is produced by compression and engine expansion of process streams. Liquid air is obtained as a liquid head product in a cold part of the process by low-temperature rectification in a column having less than four theoretical plates. In addition, a liquid bottoms product is obtained in the rectification, used exergetically and vented as a warm residual gas into the atmosphere or used at least partially in the purification step.

17 Claims, 1 Drawing Sheet

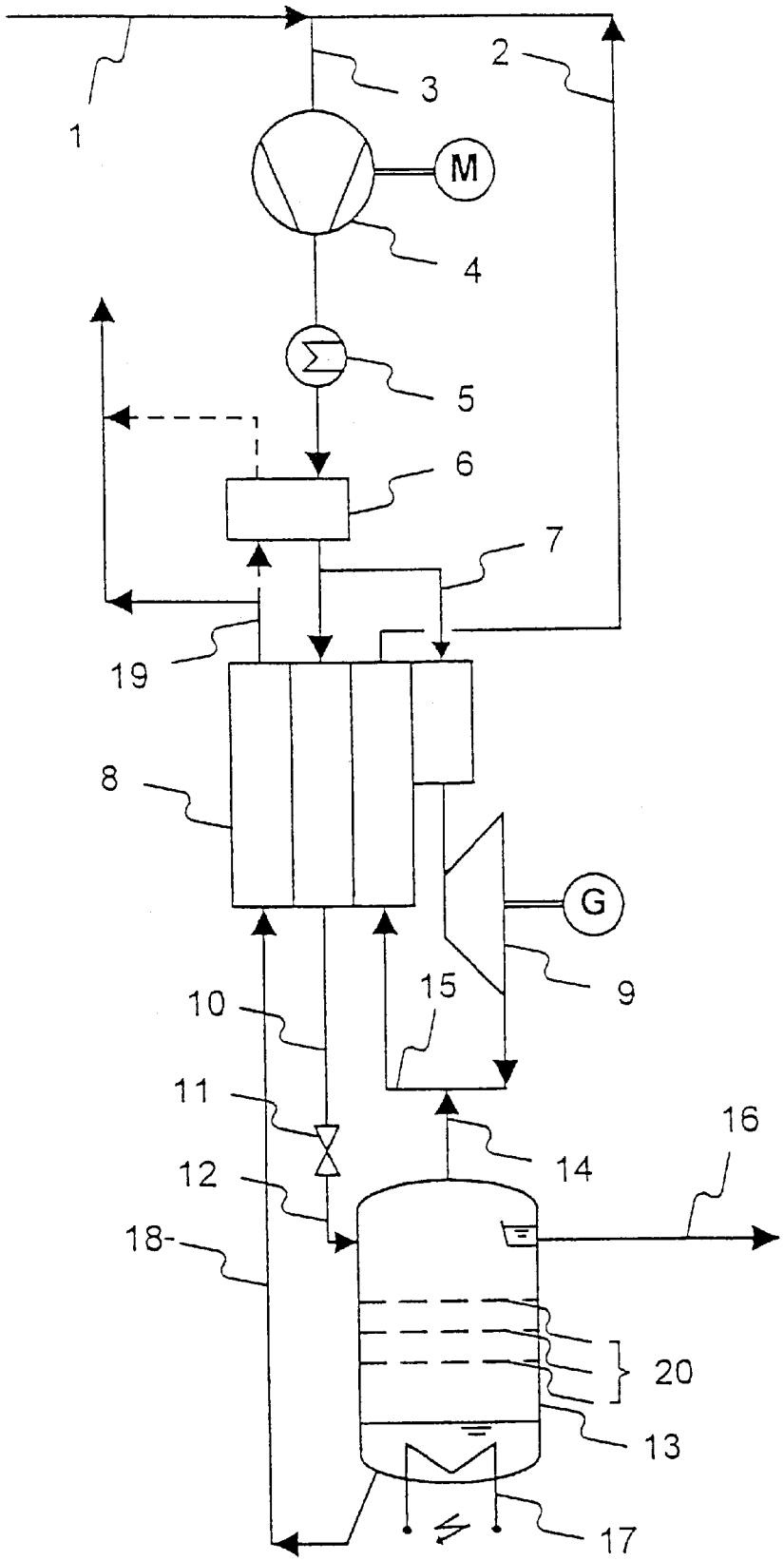
1
2
3
M
4
5
6
7
19
8
G
9
10
15
11
14
16
12
18
20
13
17

PROCESS AND LIQUEFIER FOR THE PRODUCTION OF LIQUID AIR

FIELD OF THE INVENTION

This invention relates to a process for the production of liquid air with an oxygen content of between 16 and 21 mol % in a low-temperature process, whereby atmospheric air is used as a feed gas. In a warm part of the process, $H_2O$, carbon dioxide and contaminants entrained in the air are removed; cold values are produced by compression and engine expansion of process streams, and the liquid air is obtained in a cold part of the process by low-temperature rectification.

In addition, the invention relates to a liquefier for implementing the process comprising a purification station, at least one compressor for compressing process gas, at least one expansion machine for process gas and a rectification column, a head cooling unit and a bottoms heating unit.

BACKGROUND OF THE INVENTION

A process and a liquefier have been disclosed in the article in Process Engineering (March 1997) "The Air that I Breathe." Air is liquefied in a low-temperature process, subjected to low-temperature rectification, and a liquid air product with an oxygen content of between 16.5 and 21% oxygen is produced. This air is produced by mixing an oxygen product and a nitrogen product (Synthetic Liquid Air, SLA). In this system, it is disadvantageous that there is a waste of energy to separate the air into liquid products of oxygen and nitrogen which are recombined to form SLA.

SUMMARY OF THE INVENTION

An object of the invention is, therefore, to provide a process and apparatus for the production of liquid air at a low cost. Upon further study of the specification and appended claims, other objects and advantages of the convention will become apparent.

To achieve the process aspect of the invention, there is provided a process for the production of liquid air with an oxygen content of between 16 and 21 mol % in a low-temperature process, comprising purifying atmospheric air to remove $H_2O$, carbon dioxide and contaminants entrained in the air; producing cold values by compression and engine expansion of at least one process stream, and obtaining the liquid air in a cold part of the process by low-temperature rectification, wherein the improvement comprises conducting said low-temperature rectification in a rectification column having less than four theoretical plates, withdrawing a purified liquid air head product from the rectification column, withdrawing a liquid bottoms stream from the rectification column, vaporizing the liquid bottoms stream in indirect heat exchange with air to be cooled prior to being fed to the rectification column, and venting resultant warm residual gas into the atmosphere or passing said resultant warm residual gas at least partially to the purifying step.

Thus, a characteristic feature of the process according to the invention is that the liquid air is produced with use of less than four theoretical plates as a liquid head product in the rectification and that in addition a liquid bottoms product is obtained in the rectification, used exergetically and vented as a warm residual gas into the atmosphere or used at least partially in the purifying of the compressed gas. Whereas, previously it was necessary to employ theoretical plates an order of magnitude higher to produce an oxygen product and a nitrogen product, now only a small fraction of the separative work is conducted. In addition, obtaining the liquid air as a head product avoids the requirement for intermediate storage of liquid oxygen and liquid nitrogen. Also, contaminants, for example hydrocarbons, are discharged with the liquid bottoms product. The energy content of the bottoms product is largely used, and the residual gas that accumulates after use can be fed for still an additional use.

In an advantageous embodiment of the process according to the invention, the purifying can be carried out adsorptively, wherein the residual gas can be used as a regeneration gas and/or a purge gas. Since the liquid bottoms product is removed from the rectification column to avoid a concentration of hydrocarbons in the rectification column and in the air product, and since purge gas and regeneration gas are required for adsorptive purifying, the use of the residual gas for such purposes provides synergy insofar as it is unnecessary to prepare regeneration gas and purge gas extrinsically of the process.

In a more comprehensive embodiment of the invention, a heated gas stream from the cold part of the process can be admixed to the atmospheric air, and the resulting hot mixed feed can be compressed to a starting pressure for engine expansion and then purified. As an alternative, the atmospheric air can be precompressed, a heated gas stream from the cold part of the process can be admixed, and the resulting warm mixed feed can be compressed to a starting pressure for engine expansion and then purified.

In another embodiment of the process according to the invention, the atmospheric air is precompressed and then purified, a heated gas stream from the cold part of the process is admixed, and the resulting warm mixed feed is compressed to a starting pressure for engine expansion.

The most advantageous embodiment of the compression and purifying steps in each case is determined by optimizing the process and by the availability of commercial compressors.

It is preferable to precool one part of the purified warm mixed feed compressed to the starting pressure for engine expansion countercurrently against a cold gas and against at least one fluid, e.g. the liquid bottoms product, from the rectification column to a starting temperature for the engine expansion and to further cool the resultant gas by engine expansion. It is further preferred that another part of said warm mixed feed is both precooled and countercurrently cooled again, at least partially liquefied and then depressurized isenthalpically and fed to the rectification as a throttled feed.

A head gas from the rectification column can be admixed to the engine expanded mixed feed, and both together used as the cold gas for the countercurrent cooling. This embodiment of the process according to the invention is especially advantageous when both gas streams are present at the same pressure.

The liquid bottoms product can be evaporated and heated against the warm mixed feed which is cooled. In this case, the cold content of the bottoms product is used in an especially efficient manner.

In another embodiment of the process according to the invention, the liquid bottoms product is evaporated by indirect cooling of the warm mixed feed, heated to a starting temperature for passage through a gas turbine for residual gas, expanded by the residual gas turbine, cooled again as a result and is again used to cool the warm mixed feed. The engine expansion in the residual gas turbine has advantages if an adequately high pressure drop exists between the rectification pressure and either the atmosphere or the pressure during the purifying step.

Turning now to the apparatus aspect of the invention, a characteristic feature of the liquefier according to the invention is that the bottoms heating of the rectification column is designed as indirect heating with an electric heater or with a heating tube arrangement, whereby the heating tube arrangement carries a suitable warm fluid, preferably a warm process gas, and that the number of separating stages corresponds to less than four theoretical plates.

The electric heater is especially suitable for small units, in which a correspondingly higher power consumption is not important compared to the cost for the installation of a heating tube arrangement with related process gas lines. The low number of separating stages ensures a small overall pressure drop for the gas conversion in the rectification column. A head condenser is avoided since liquid from the throttled feed forms the column reflux. In the process according to the prior art, however, columns with condensers and a considerable number of separating stages are used. The liquid air produced according to the invention thus requires less investment and less energy because of the small pressure drop in the column.

The purifying station is preferably designed with reversible molecular sieve adsorbers, whereby at least one adsorber with process gas that is to be purified and at least one additional adsorber are flushed with regeneration gas or purge gas, whereby residual gas from the liquefier can be used as regeneration gas or purge gas.

The devices for compression are preferably designed as turbine compressors. In one embodiment of the process, the precompressor and main compressor can be affixed to a common shaft, using only one motor.

The engine expansion machines are preferably turbines, and preferably turbines integrated in a turbine/booster arrangement or in a turbine/generator arrangement.

BRIEF DESCRIPTION OF THE DRAWING

The attached FIGURE is a schematic flowsheet of an embodiment of the invention. The FIGURE illustrates a process according to the invention wherein a heated gas stream is mixed with atmospheric air.

DETAILED DESCRIPTION OF THE DRAWING

Atmospheric air 1 is mixed with a heated partial stream 2 from the cold part of the process and the resultant mixture is fed as a warm mixed feed 3, is compressed in a compressor 4, in most cases with intermediate cooling between compressor stages (not depicted in the FIGURE). The compressed feed is passed to an after-cooler 5 provided with a water separator and then to an adsorption unit 6 provided with reversible molecular sieve adsorbers. A partial stream 7 from the adsorption unit is precooled in a heat exchanger 8 to a suitable starting temperature for coupled turbine generator 9 wherein further cooling occurs by substantially isentropic expansion of the partial stream.

Another partial stream of warm mixed feed 3 is cooled in heat exchanger 8, at least partially liquefied, and preferably completely liquefied and subcooled to form stream 10 which is depressurized in throttle value 11 where it is further cooled. (The throttling provides about 5–10 mol % vapor depending on the extent of subcooling.) The resultant further cooled stream is then fed to a rectification column 13. An overhead gas 14 from the rectification column 13 is mixed with isentropically expanded cold partial stream 7 to form a cold gas 15. The resultant mixture of cold gases is passed through heat exchanger 8 to provide a heated gas stream 2 which is mixed with atmospheric air 1 to form feed 3. A fluid, approximately 95–99 mol %, preferably about 97 mol % obtained from throttle value 11 is used partly in rectification column 13 as a reflux while another part is removed near the head of the rectification column as a liquid air product 16. A bottoms liquid that accumulates in the column is heated by electrically heated evaporator 17 to produce vapor for operation of the rectification column. A part 18 of the bottoms liquid is evaporated in heat exchanger 8, heated as residual gas 19, used at least partially in adsorption unit 6 as a purge and regeneration gas and vented into the atmosphere. Rectification column 13 is equipped with mass transfer components 20 equivalent to less than four theoretical plates in this case three theoretical plates. Bubble trays are preferred. The column is operated generally at reflux ratio of about 0.5–0.8:1, preferably 0.7:1.

EXAMPLE

For the process according to the invention according to the FIGURE, process data are indicated in the table.

TABLE

| Line No. | Temp. K | Pressure bar | Amount $Nm^3/h$ | $N_2$ mol % | Ar mol % | $O_2$ mol % | Phase |
|---|---|---|---|---|---|---|---|
| 1 | 295 | 1.02 | 1106 | 78.118 | 0.932 | 20.95 | 1 |
| 2 | 295 | 1.02 | 7282 | 81.000 | 0.900 | 18.10 | 1 |
| 3 | 295 | 1.02 | 8388 | 80.600 | 0.900 | 18.50 | 1 |
| 7 | 300 | 19.50 | 7066 | 80.600 | 0.900 | 18.50 | 1 |
| 10 | 84.5 | 19.40 | 1322 | 80.600 | 0.900 | 18.50 | 2 |
| 14 | 81.6 | 1.30 | 216 | 93.500 | 0.400 | 6.10 | 1 |
| 16 | 81.6 | 1.30 | 1000 | 80.100 | 0.900 | 19.0 | 2 |
| 18 | 83.6 | 1.40 | 105 | 58.900 | 1.600 | 39.50 | 2 |

Phase 1 corresponds to a vapor proportion = 100 mol %
Phase 2 corresponds to a vapor proportion = 0 mol %
Evaporator output: 10 kW
Compressor output: 1 MW Whereas the preceding description of the invention includes a rectification column having less than four theoretical plates, it is also contemplated that the invention will be advantageous when employing two to four theoretical plates in the rectification column.

In general, the present invention will be particularly useful for commercial size liquid air plants delivering 500–6000 liters per hour of liquid air. Such plants are useful in general where needed, but particularly in the frozen food industry and for the deburring of rubber articles.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application 19843629.7, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the production of liquid air with an oxygen content of between 16 and 21 mol % in a low-temperature process, comprising purifying atmospheric air to remove $H_2O$, carbon dioxide and contaminants entrained in the air; producing cold values by compression and engine expansion of at least one process stream, and obtaining the liquid air in a cold part of the process by low-temperature rectification, the improvement comprising conducting said low-temperature rectification in a rectification column having less than four theoretical plates, withdrawing a purified liquid air head product from the rectification column, withdrawing a liquid bottoms stream from the rectification column, vaporizing the liquid bottoms stream in indirect heat exchange with air to be cooled prior to being fed to the rectification column, and venting resultant warm residual gas into the atmosphere or passing said resultant warm residual gas at least partially to the purifying step, and further comprising precompressing atmospheric air, mixing the resultant precompressed air with a gas stream withdrawn from the cold part of the process and then heated, and compressing the resulting warm mixed feed to a starting pressure for engine expansion.

2. A process according to claim 1, wherein the purifying is carried out in an adsorption system, and passing the warm residual gas to said adsorption system as at least one of a regeneration gas and a purge gas.

3. A process according to claim 1, further comprising mixing atmospheric air with a gas stream withdrawn from the cold part of the process and then heated, and compressing the resulting warm mixed feed to a starting pressure for engine expansion and then purifying said compressed gas.

4. A process according to claim 1, further comprising purifying the resulting warn mixed feed compressed to a starting pressure for engine expansion.

5. A process according to claim 1, wherein one part of the purified warm mixed feed compressed to said starting pressure is precooled countercurrently against a cold gas against the liquid bottoms product of the rectification, to a starting temperature for the engine expansion and cooled further again by the engine expansion, while another part of said warm mixed feed is countercurrently both precooled, further cooled, at least partially liquefied and then depressurized isenthalpically and fed to the rectification as a throttled stream.

6. A process according to claim 5, wherein the part of the engine expanded mixed feed is admixed to a head gas from the rectification and together constitute the cold gas for said countercurrent cooling.

7. A process according to claim 5, wherein the liquid bottoms product is evaporated and heated during the cooling of the warm mixed feed.

8. A process according to claim 5, wherein the liquid bottoms product is evaporated during the cooling of the warm mixed feed, heated to a starting temperature for a residual gas turbine, expanded through the residual gas turbine, thereby being further cooled and then passed in indirect heat exchange for cooling the warm mixed feed.

9. A process according to claim 1, wherein the rectification column has three theoretical plates.

10. A liquefier system for producing liquid air comprising a purifying station, at least one compressor, at least one device for engine expansion of process gas, and a rectification column comprising separating stages installed in the rectification column, a head cooling unit and a bottoms heating unit, wherein the bottoms heating comprises an electric heater or heating tubes, and wherein the number of separating stages in the column corresponds to less than four theoretical plates, and wherein the purifying station comprises reversible molecular sieve adsorbers, with conduit for introducing process gas to be purified into at least one adsorber and for introducing into at least one other adsorber regeneration gas or purge gas, whereby residual gas from the liquefier can be used as a regeneration gas or purge gas.

11. A liquefier according to claim 10, wherein the at least one compressor is a turbine compressor.

12. A liquefier according to claim 10, wherein the engine expansion devices are turbines.

13. A liquefier according to claim 12, wherein a turbine is connected to a booster by a common shaft.

14. A liquefier according to claim 12, wherein a turbine is connected to a generator by a common shaft.

15. A liquefier system according to claim 10, wherein the rectification column has contact structure corresponding to three theoretical plates.

16. A liquefier system according to claim 10, wherein the bottoms heating unit is an electric heater.

17. In a process for the production of liquid air with an oxygen content of between 16 and 21 mol % in a low-temperature process, comprising purifying atmospheric air to remove $H_2O$, carbon dioxide and contaminants entrained in the air; producing cold values by compression and engine expansion of at least one process stream, and obtaining the liquid air in a cold part of the process by low-temperature rectification, the improvement comprising conducting said low-temperature rectification in a rectification column having less than four theoretical plates, withdrawing a purified liquid air head product from the rectification column, withdrawing a liquid bottoms stream from the rectification column, vaporizing the liquid bottoms stream in indirect heat exchange with air to be cooled prior to being fed to the rectification column, and venting resultant warm residual gas into the atmosphere or passing said resultant warm residual gas at least partially to the purifying step, further comprising mixing atmospheric air with a gas stream withdrawn from the cold part of the process and then heated, and compressing the resulting warm mixed feed to a starting pressure for engine expansion and then purifying said compressed gas.

* * * * *